US008978891B2

(12) United States Patent
Mitsuhashi

(10) Patent No.: US 8,978,891 B2
(45) Date of Patent: Mar. 17, 2015

(54) STRUCTURE AND METHOD FOR PACKING DISPLAY DEVICE

(75) Inventor: Renichi Mitsuhashi, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 474 days.

(21) Appl. No.: 13/138,546

(22) PCT Filed: Apr. 7, 2009

(86) PCT No.: PCT/JP2009/057124

§ 371 (c)(1),
(2), (4) Date: Sep. 1, 2011

(87) PCT Pub. No.: WO2010/116490

PCT Pub. Date: Oct. 14, 2010

(65) Prior Publication Data

US 2011/0308979 A1 Dec. 22, 2011

(51) Int. Cl.

| | |
|---|---|
| ***B65D 81/02*** | (2006.01) |
| ***B65D 85/30*** | (2006.01) |
| ***B65D 81/05*** | (2006.01) |
| ***B65D 81/113*** | (2006.01) |

(52) U.S. Cl.

CPC ..... *B65D 81/057* (2013.01); *B65D 81/113* (2013.01); *B65D 2585/6837* (2013.01)

USPC ..... 206/586; 206/523; 206/449; 206/453; 206/591

(58) Field of Classification Search

USPC ..... 206/454, 453, 523, 521, 532, 586–588, 206/592, 599, 529, 493, 449

See application file for complete search history.

(56) References Cited

U.S. PATENT DOCUMENTS

| | | | | |
|---|---|---|---|---|
| 5,715,940 | A * | 2/1998 | Son | 206/320 |
| 6,092,651 | A * | 7/2000 | Miller | 206/305 |
| 6,769,547 | B2 * | 8/2004 | Yu | 206/586 |
| 7,588,148 | B2 * | 9/2009 | Yang | 206/523 |
| 2005/0161366 | A1 * | 7/2005 | Kobashi et al. | 206/586 |

(Continued)

FOREIGN PATENT DOCUMENTS

| | | |
|---|---|---|
| CN | 200995853 Y | 12/2007 |
| CN | 201151532 Y | 11/2008 |

(Continued)

OTHER PUBLICATIONS

Chinese Office Action dated Jan. 5, 2013, with partial English translation.

(Continued)

*Primary Examiner* — Mickey Yu
*Assistant Examiner* — Chun Cheung
(74) *Attorney, Agent, or Firm* — McGinn IP Law Group, PLLC

(57) ABSTRACT

A cushioning material includes a recess forming member that includes a protecting member and an engaging member to form a recess that contains inside an edge portion of a thin display device, and moreover on a rear frame that is positioned on a back surface of the thin display device a handle is provided that forms a gap between a display screen of the thin display device and a protecting member of the cushioning material that is positioned in front of the display screen by engaging and holding the engaging member of the cushioning material in a state of the edge portion of the thin display device being contained in the recess of the cushioning material.

21 Claims, 13 Drawing Sheets

(56) References Cited

U.S. PATENT DOCUMENTS

| | | | | |
|---|---|---|---|---|
| 2008/0053866 | A1* | 3/2008 | Cheng et al. | 206/592 |
| 2009/0090652 | A1 | 4/2009 | Torikai et al. | |

FOREIGN PATENT DOCUMENTS

| | | | |
|---|---|---|---|
| CN | 101426696 | A | 5/2009 |
| EP | 1 902 974 | A1 | 3/2008 |
| JP | 2005-112367 | A | 4/2005 |
| JP | 2005-231655 | A | 9/2005 |
| JP | 2008-094413 | A | 4/2008 |
| WO | WO2007/123070 | A1 | 11/2007 |

OTHER PUBLICATIONS

International Search Report (ISR) dated Jul. 14, 2009.

* cited by examiner

STRUCTURE AND METHOD FOR PACKING DISPLAY DEVICE

TECHNICAL FIELD

The present invention relates to a packing structure and a packing method applied to a thin display device such as a liquid crystal display device, a plasma display device, and an organic EL display device, and that can exhibit a sufficient cushioning property during transport and storage.

BACKGROUND ART

Patent Document 1 discloses a conventional technique relating to a packing material for packing a thin display device such as a liquid crystal display device, a plasma display device, and an organic EL display device.

Hereinbelow, the packing material that is shown in Patent Document 1 shall be described with reference to FIG. 9 to FIG. 13. First, that which is shown in FIG. 9 is a thin display structure 50 such as a liquid crystal display device, a plasma display device, and an organic EL display device that is the packing target, and is a structure that has a frame 52 serving as a chassis around a display screen 51. The frame 52 has a width of 1 cm or more around the display screen 51 in order to house the drive circuit of the display screen 51, or to fix the display screen 51 to a rear frame 53.

FIG. 10 and FIG. 11 are perspective views that show the packing material 60 for packing the thin display device 50, being constituted from a packing box 61 shown in FIG. 10 and a cushioning material 62 that is shown in FIG. 11.

Cardboard is normally used for the packing box 61. Also, a foam material is normally used for the cushioning material 62, which is arranged between the corner portions of the thin display device 50 and the packing box 61 with no gaps therebetween in order to cushion shocks during transport that are imparted to the thin display device 50.

PRIOR ART DOCUMENT

Patent Document

[Patent Document 1] Japanese Unexamined Patent Application, First Publication No. 2008-094413

SUMMARY OF THE INVENTION

Problem to be Solved by the Invention

When the cushioning material 62 touches the display screen 51 of the thin display device 50, there is increased a possibility of defects occurring on the display screen 51. This is because the display surface of the display screen 51 is formed with liquid crystal, plasma, or organic EL, so when whichever surface is pushed with a strong force from outside, the inside is damaged and a defect occurs on the screen.

FIG. 12 is a transverse sectional view of packaging for a conventional liquid crystal thin display device 50. The thin display device 50 is held by the cushioning material 62, which is shaped so as not to come into contact with the display screen 51 of the thin display device 50. Cushioning in the vertical direction of the figure is performed by holding the back surface and the frame 52 of the thin display device 50 with the cushioning material 62.

However, in the thin display device 50 until now, the frame 52 has been 1 cm or greater, and so it was possible to hold the cushioning material 62 with this portion. But in the thin display device 50 of recent years, a narrow frame 52' whose width is less than 1 cm as shown in FIG. 13 has been used. This is because this narrow frame 52' with a narrow width enables easier viewing when using the display screen 51 in a multi-screen configuration. Then, when packing in the conventional manner the thin display device 50 that has this kind of narrow frame 52', since the narrow frame 52' does not have a sufficient surface area around the display screen 51, the cushioning material 62 and the display screen 51 make contact due to shocks and vibration during transport, and so there has been the risk of breaking the display screen 51.

The present invention has been conceived in view of the above circumstances, and provides a packing structure and a packing method for a display device that prevents the cushioning material and the display screen from making contact so as not to break the display screen, even if a narrow width frame is used that does not have a sufficient surface area around the display screen.

Means for Solving the Problem

In order to solve the aforementioned issues, the present invention provides the following means. That is, the present invention provides a packing structure which includes a cushioning material for protecting a display device, the cushioning material includes a recess forming member for forming a recess that contains inside an edge portion of the display device, and a handle that engages and holds the cushioning material is provided on a back surface of the display device in a state of the edge portion of the display device being contained in the recess of the cushioning material, in order to form a gap between a display screen of the display device and a recess forming piece of the cushioning material positioned in front of the display screen.

Also, the present invention provides a packing method that uses a cushioning material for packing a display device, and that includes forming in the cushioning material a recess for containing inside an edge portion of the display device using a recess forming member, and further providing on a back surface of the display device a handle that engages and holds the cushioning material in a state of the edge portion of the display device being contained in the recess of the cushioning material, in order to form a gap between a display screen of the display device and a recess forming piece of the cushioning material positioned in front of the display screen.

Effect of the Invention

According to the present invention, the cushioning material includes a recess forming member for forming a recess that contains inside an edge portion of the display device, and moreover, a handle that engages and holds the cushioning material is provided on a back surface of the display device in a state of the edge portion of the display device being contained in the recess of the cushioning material, in order to form a gap between a display screen of the display device and a recess forming piece of the cushioning material positioned in front of the display screen. Therefore, the cushioning material is fixed in a stable manner to the display device by the handle. As a result, even if a narrow-width frame that does not have a sufficient surface area around the display screen is used at the edge portion of the thin display device; the cushioning material and the display screen are prevented from making contact during packing, and so it is possible to prevent damage to the display screen before it happens.

REFERENCE SYMBOLS

Figure 1:
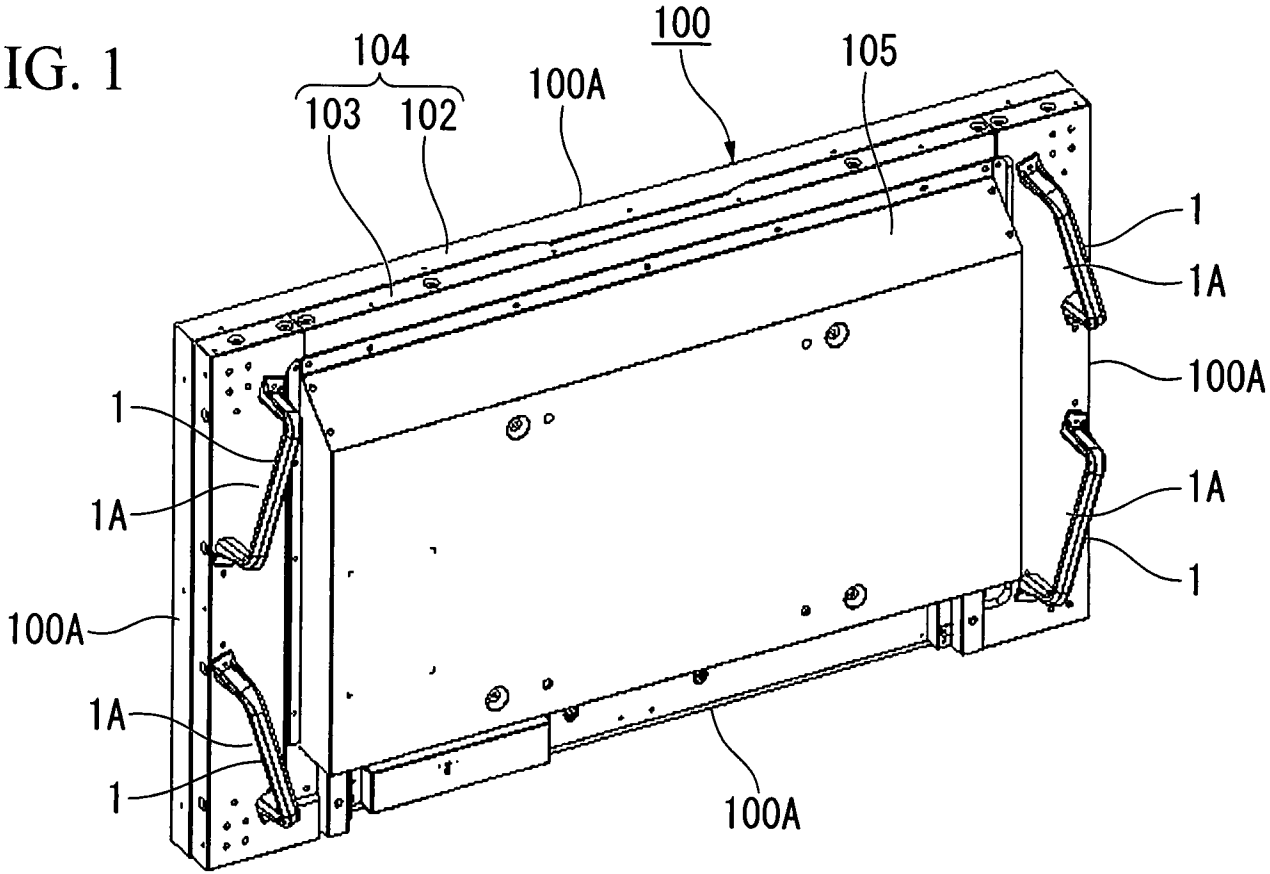
FIG. 1 is a perspective view of a thin display device seen from the rear side.

1 Handle
2 Cushioning material
3 Recess
4 Recess forming member
5 Protecting member
6 Engaging member
10 Gap
11 Step portion
12 Cardboard (packing material)
20 Cushioning material
21 Engaging member
22 First cushioning member
23 Protecting member
24 Second cushioning member
25 Gap forming member
30 Gap
31 Recess
32 Recessing forming member
33 Step portion
34 Cardboard (packing box)
100 Thin display device
100A Edge portion
101 Display screen

EMBODIMENTS FOR CARRYING OUT THE INVENTION

[First Exemplary Embodiment]

A packing structure and packing method according to a first exemplary embodiment of the present invention shall be described with reference to FIG. 1 to FIG. 4. FIG. 1 is a perspective view seen from the rear side of a thin display device 100 such as a liquid crystal display device, a plasma display device, or an organic EL that is the packing target. This thin display device 100 has a frame 102 that is provided on the front-side perimeter of a display screen 101 so as to surround the display screen 101, and a rear frame 103 that supports the frame 102, with a chassis 104 being constituted by the frame 102 and the rear frame 103. The frame 102 is constituted as a narrow edge with a width of less than 1 cm around the display screen 101 in order to facilitate viewing of multiple screens. Also, a drive portion 105 for driving the display screen 101 is provided in the center of the rear frame 103.

Moreover, a total of four handles 1 are provided in each corner portion of the rear frame 103 that constitutes a portion of the chassis 104 of this thin display 100. These handles 1 are arranged at each corner portion of the rear frame 103 so as to be slanted with respect to the upper edge portion, the side edge portion and the lower edge portion. The inner side of each handle 1 serves as a holding portion 1A that engages with and holds a cushioning material 2 described below after the cushioning material 2 has been inserted.

Next, the cushioning material 2 that is held by each handle 1 in order to pack the aforementioned thin display device 100 shall be described with reference to FIGS. 2 to 4. In this first exemplary embodiment, the cushioning material 2 includes plastic, such as expanded polyethylene or expanded polystyrene or expanded polypropylene with a foaming ratio of 40 to 50%, and by means of this material constitution has a high cushioning property with respect to external shocks.

Figure 2:
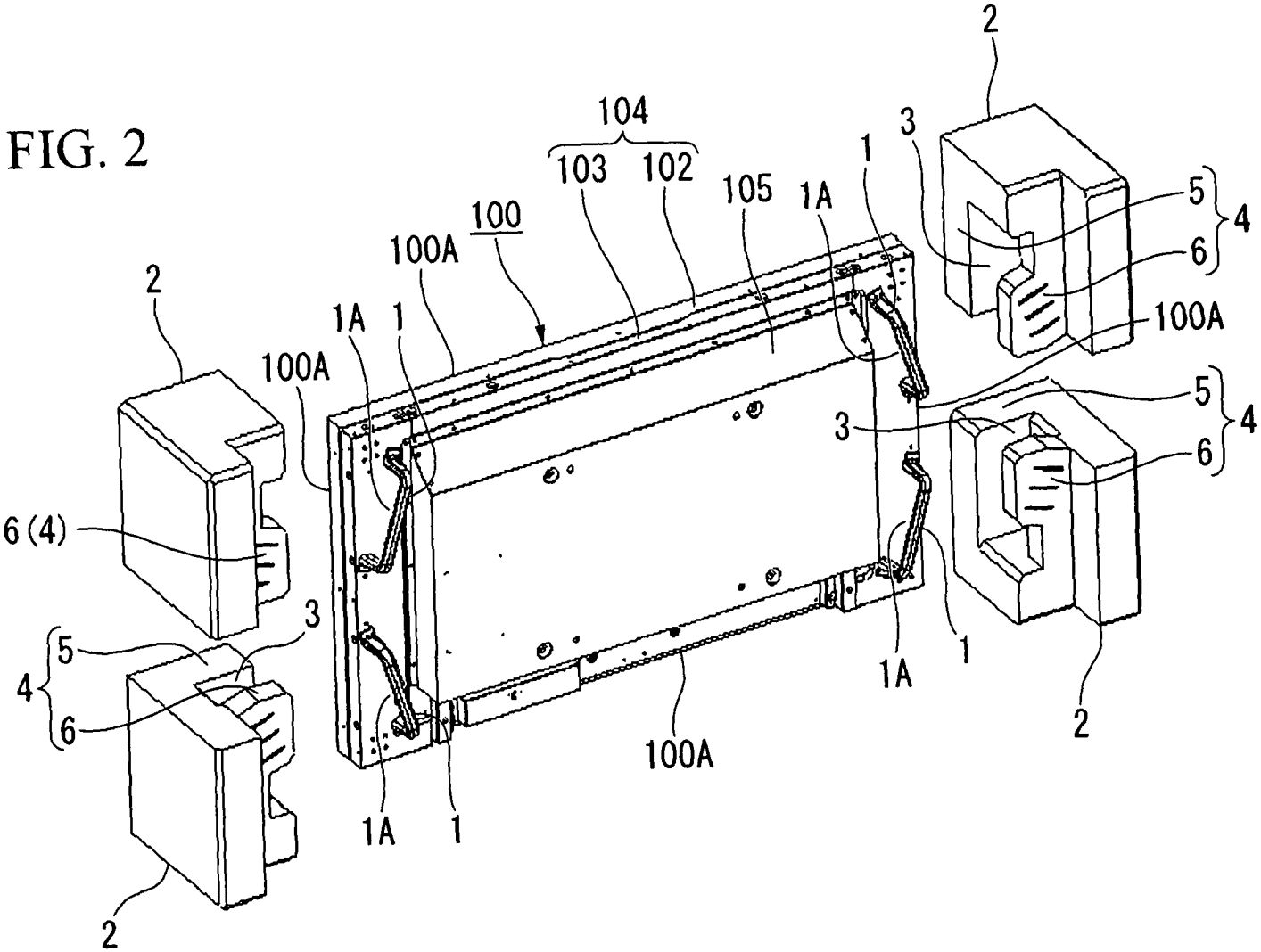
FIG. 2 is a perspective view of a cushioning material according to a first exemplary embodiment, showing the appearance of the cushioning material attached to a thin display device.
Figure 3:
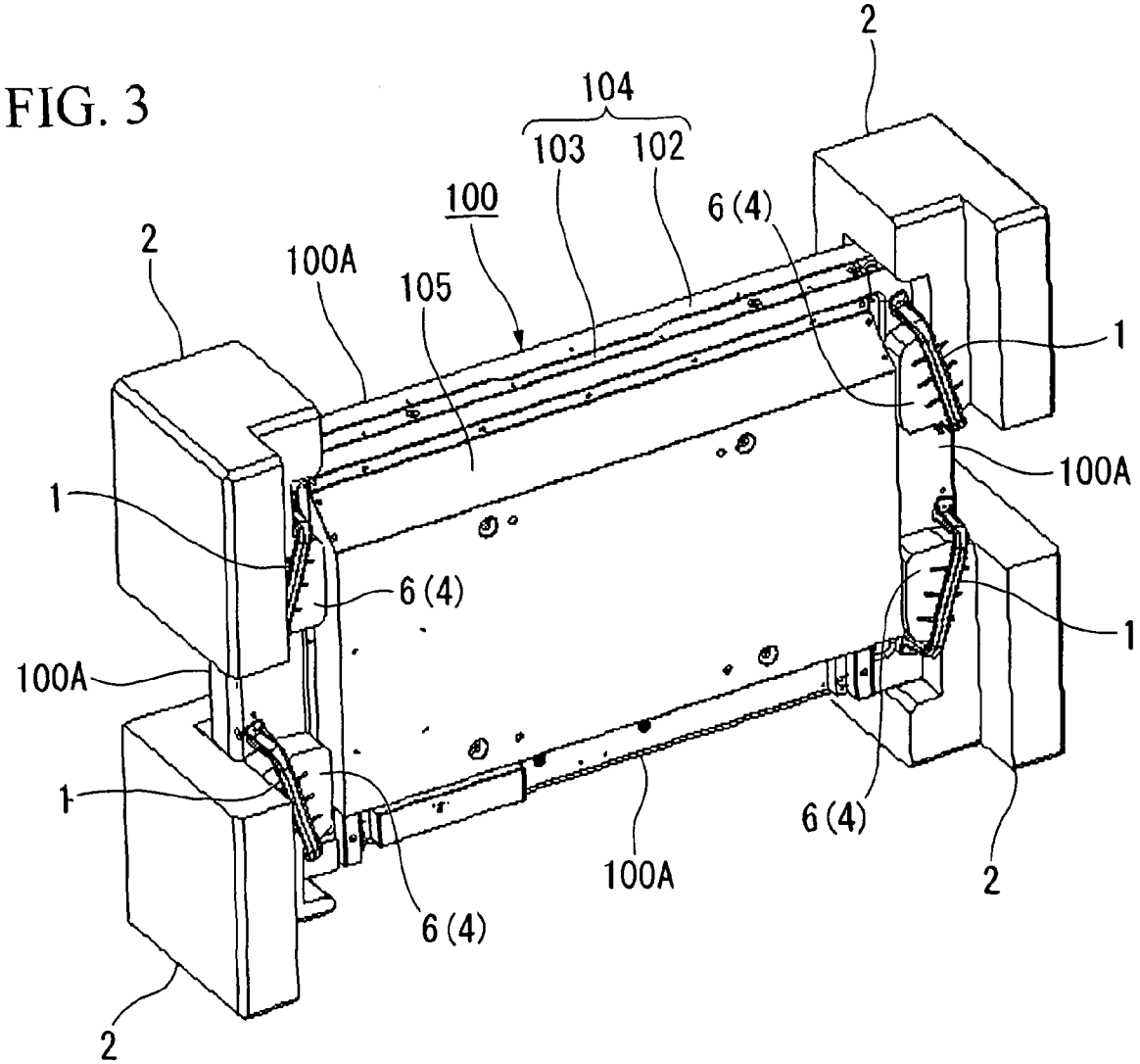
FIG. 3 is a perspective view of the cushioning material of FIG. 2 attached to the thin display device.

As shown in FIG. 2 and FIG. 3, the cushioning material 2 has a recess forming member 4 that forms a recess 3 for housing therein an edge portion 100A of the thin display device 100, and the recess forming member 4 includes a protecting member 5 that is positioned on the front side and an engaging member 6 that is positioned on the rear side.

The protecting member 5 protects the display screen 101 by being arranged at the front of the display screen 101 of the thin display device 100 in the case of being attached to the edge portion 100A of the thin display device 100. Furthermore, the engaging member 6 is for fixing and holding the cushioning material 2 by being engaged in the holding portion 1A of the handle 1. The aforementioned recess 3 is formed between the protecting member 5 and the engaging member 6.

Figure 4:
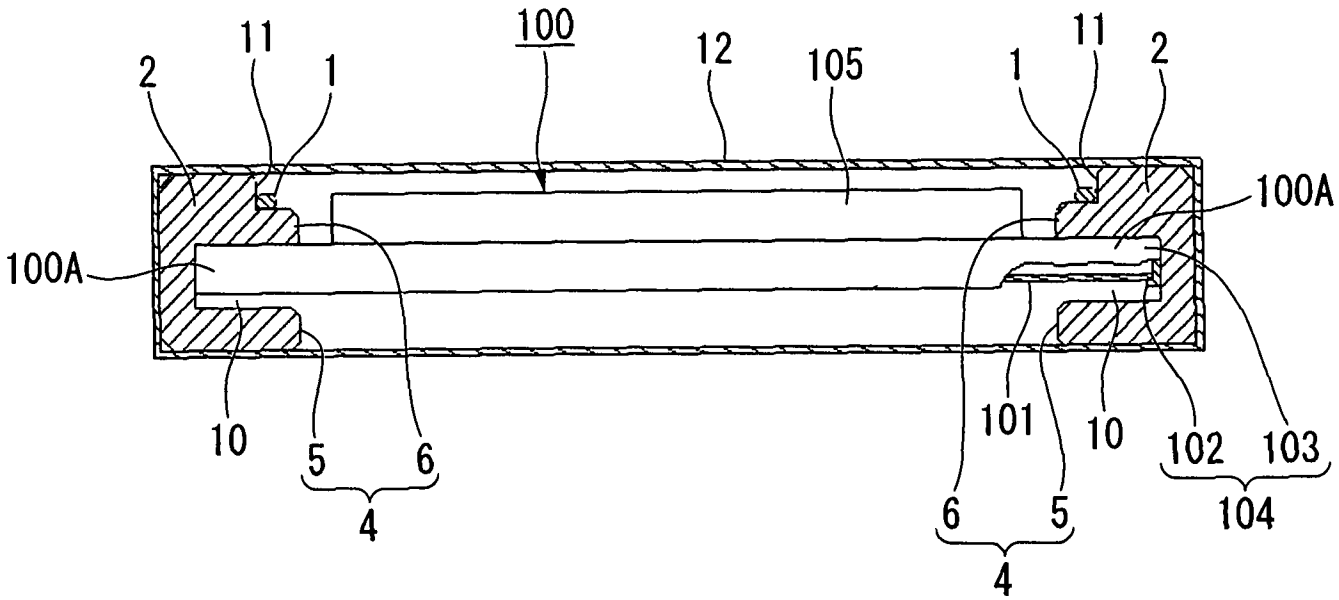
FIG. 4 is a transverse sectional view that shows the state of the thin display device on which the cushioning material is attached being stored in a packing box.

In the state of housing the edge portion 100A of the thin display device 100 in the recess 3 between the protecting member 5 and the engaging member 6, when the rear side engaging member 6 is engaged in the holding portion 1A of the handle 1, as shown in FIG. 4, a gap 10 of a certain interval is formed between the display screen 101 of the thin display device 100 and the protecting member 5 that is positioned in front of the display screen 101, and this gap 10 prevents the protecting member 5 and the display screen 101 from making contact.

Also, a step portion 11 is formed at the rear of the cushioning material 2. This step portion 11, in the state of the cushioning material 2 being attached to the handle 1 of the thin display device 100, has a role of positioning and fixing the cushioning material 2 with respect to the edge portion 100A of the thin display device 100 by making contact with the handle 1.

Also, the thin display device 100 to which this kind of cushioning material 2 is attached is contained in a cardboard box that serves as a packing material as shown by reference symbol 12 in FIG. 4. This cardboard box 12 is formed to match the external dimensions of the thin display device 100 including the cushioning material 2, and in the case of storing the thin display device 100 together with the cushioning material 2, the cushioning material 2 does not rattle due to the support of the step portion 11 that makes contact with the handle 1 of the thin display device 100.

Since the packing structure and packing method according to the first exemplary embodiment as described in detail above provides the recess forming member 4 that includes the protecting member 5 and the engaging member 6 for forming the recess 3 that houses inside the edge portion 100A of the thin display device 100 in the cushioning material 2, and provides on the rear frame 103 that is positioned on the back surface of the thin display device 100 the handle 1 that forms the gap 10 between the display screen 101 of the thin display device 100 and the protecting member 5 of the cushioning material 2 that is positioned in front of the display screen 101 by engaging and holding the engaging member 6 of the cushioning material 2 in the state of the edge portion 100A of the thin display device 100 being contained in the recess 3 of the cushioning material 2, the handle 1 can fix the cushioning material 2 in a stable manner with respect to the thin display device 100.

As a result, even if a narrow-width frame 102 that does not have a sufficient surface area around the display screen 101 is used at the edge portion 100A of the thin display device 100, the cushioning material 2 and the display screen 101 are prevented from making contact during packing, and so it is possible to prevent damage to the display screen 101 before it happens.

[Second Exemplary Embodiment]

The packing structure and packing method according to a second exemplary embodiment of the present invention shall be described with reference to FIG. 5 to FIG. 8.

The second exemplary embodiment has a constitution of the cushioning material that differs from the first exemplary embodiment. The cushioning material 20 that is shown in the second exemplary embodiment is constituted by two members, instead of being formed by one member as in the first exemplary embodiment.

Figure 5:
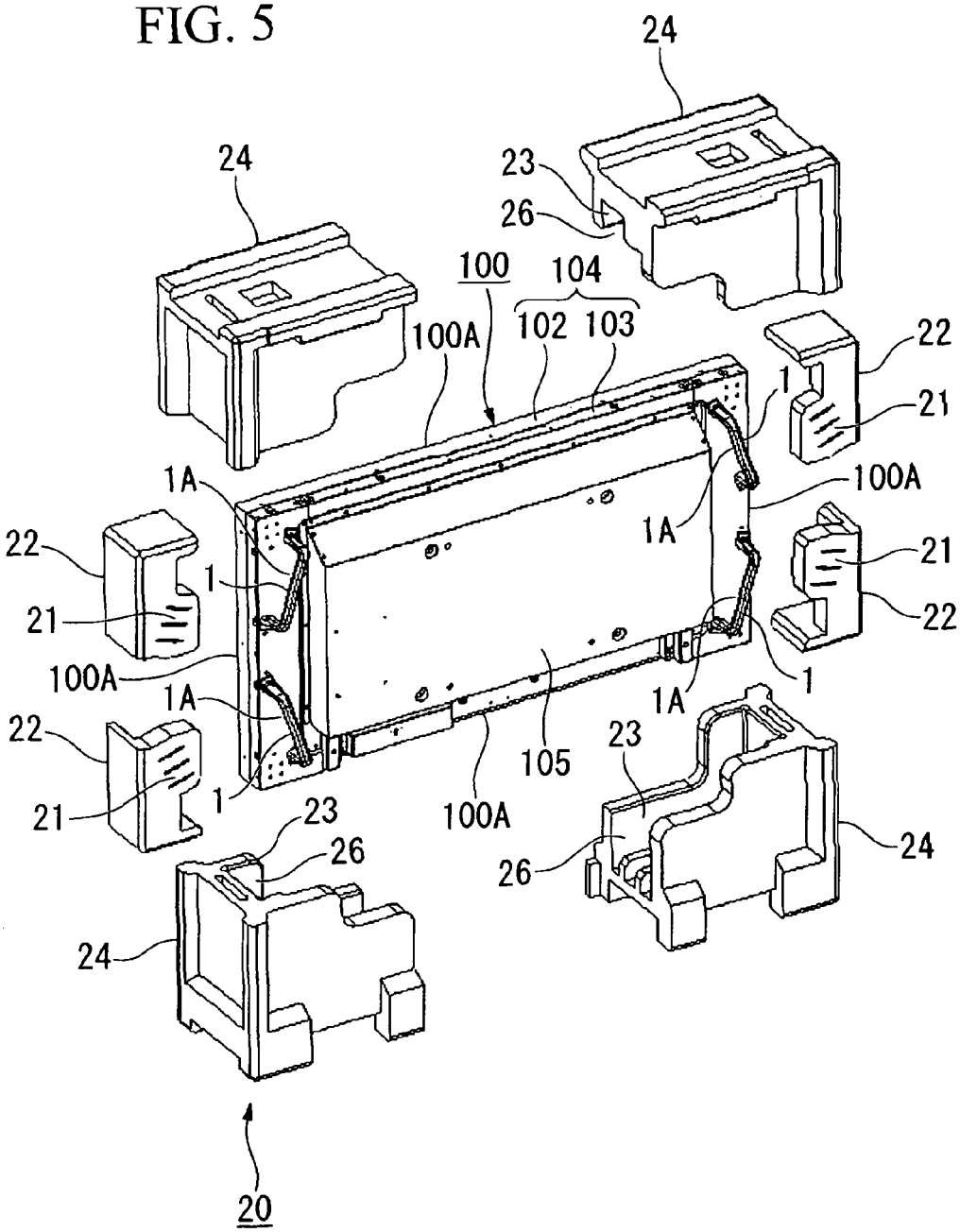
FIG. 5 is a perspective view of a cushioning material according to a second exemplary embodiment, showing the appearance of the cushioning material attached to a thin display device.
Figure 6:
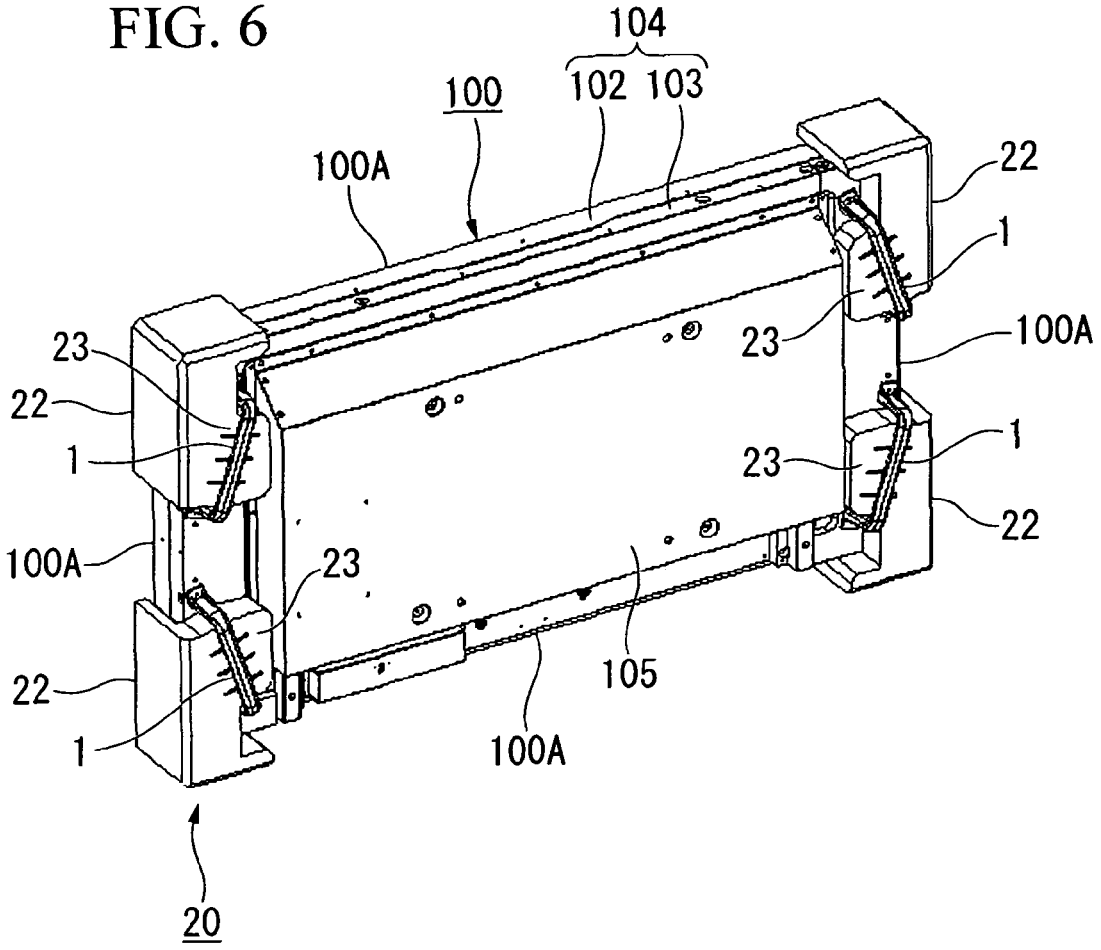
FIG. 6 is a perspective view of a first cushioning member attached to the thin display device.
Figure 7:
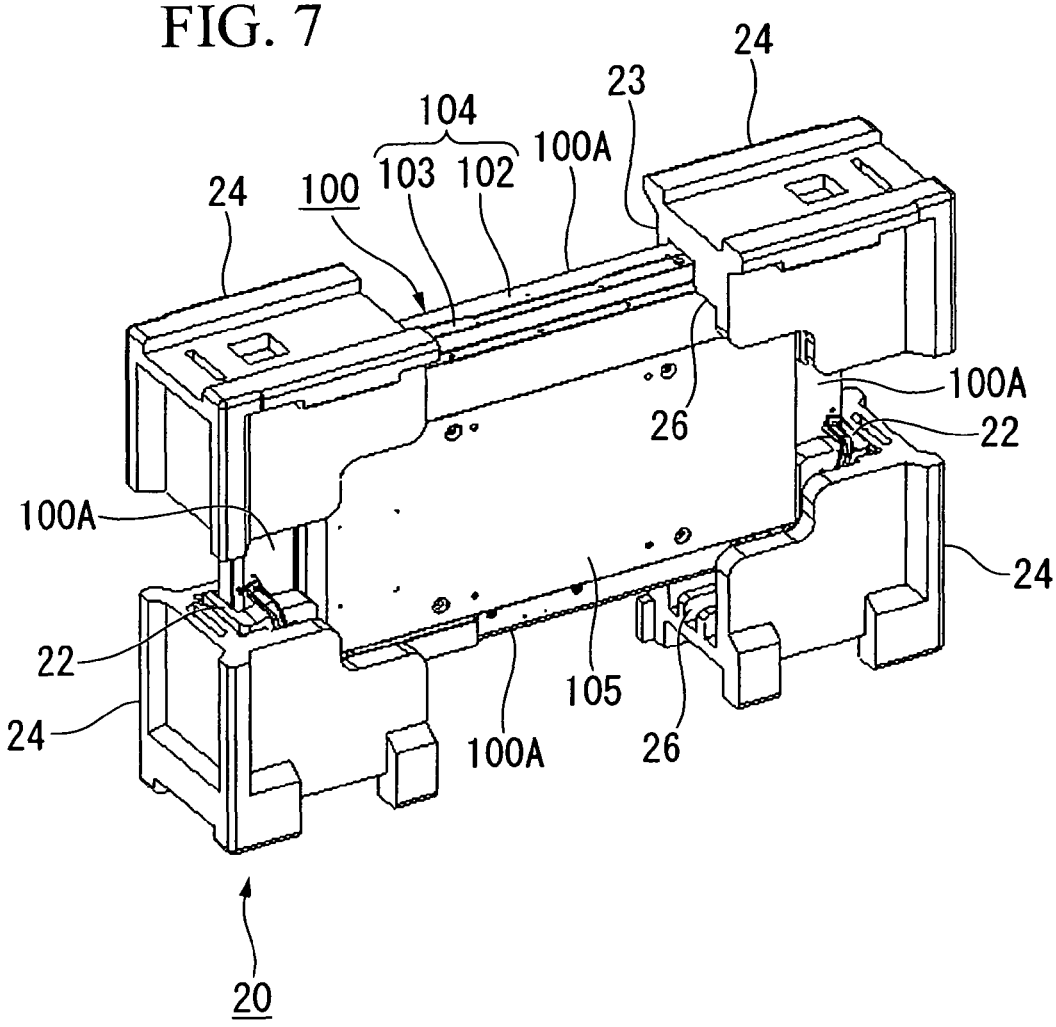
FIG. 7 is a perspective view of a second cushioning member attached to the thin display device.

That is, the cushioning material 20 of the second exemplary embodiment, as shown in FIG. 5 to FIG. 7, includes a first cushioning member 22 that has an engaging member 21 that is engaged with the handle 1 on the back surface of the thin display device 100, and a second cushioning member 24 that has a protecting member 23 that protects the display screen 101 by being arranged in front of the display screen 101 of the thin display device 100, in the state of being attached to the edge portion 100A of the thin display device 100. The second cushioning member 24 functions as a spacer of the first cushioning member 22.

Figure 8:
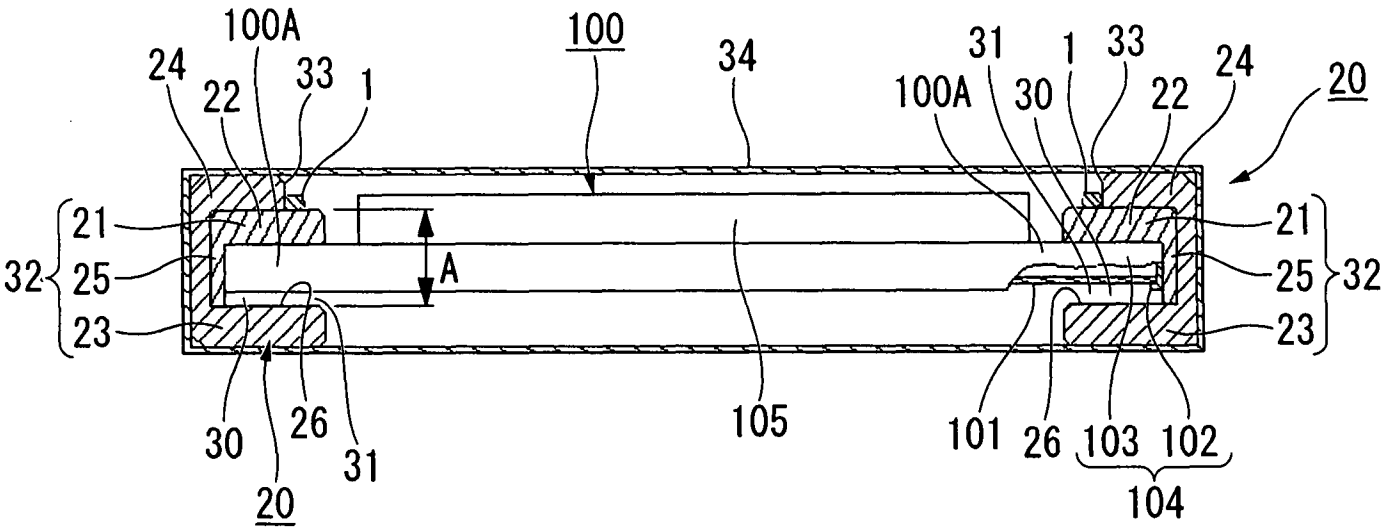
FIG. 8 is a transverse sectional view that shows the state of the thin display device on which the first and second cushioning members are attached being stored in a packing box.
Figure 9:
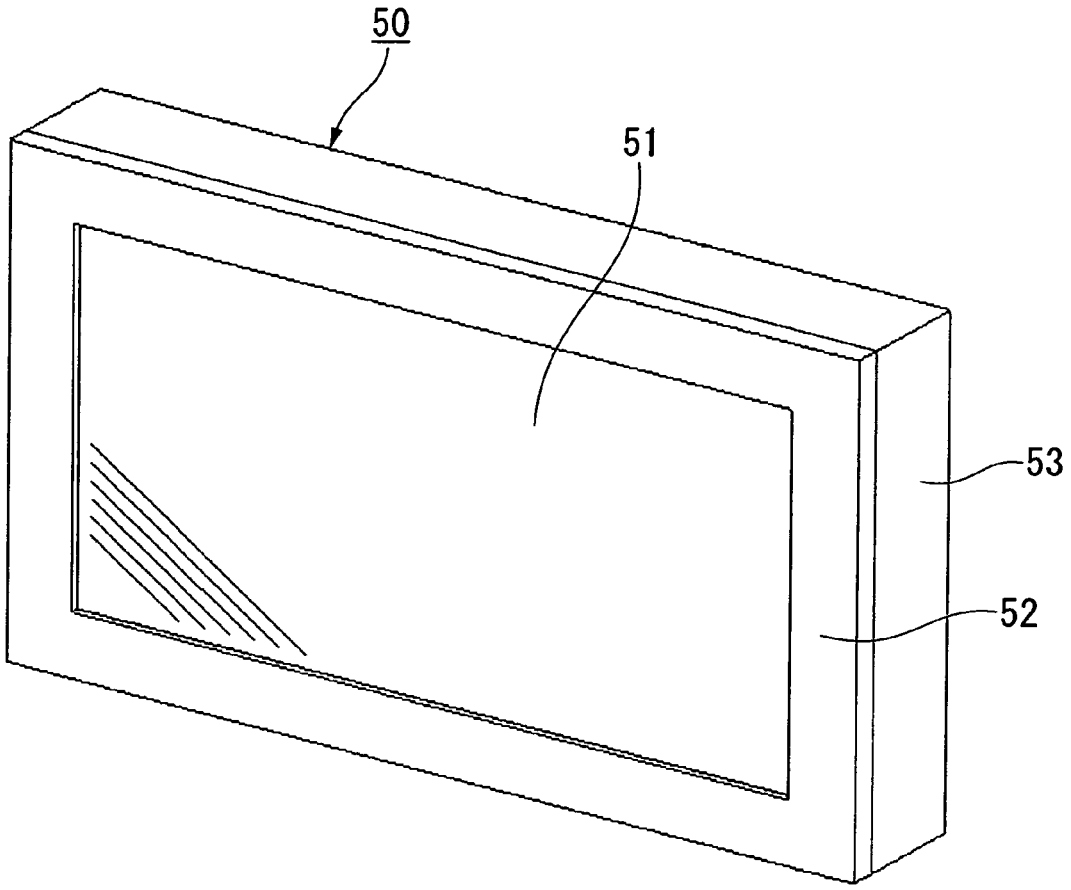
FIG. 9 is a perspective view of a conventional thin display device seen from the front side.
Figure 10:
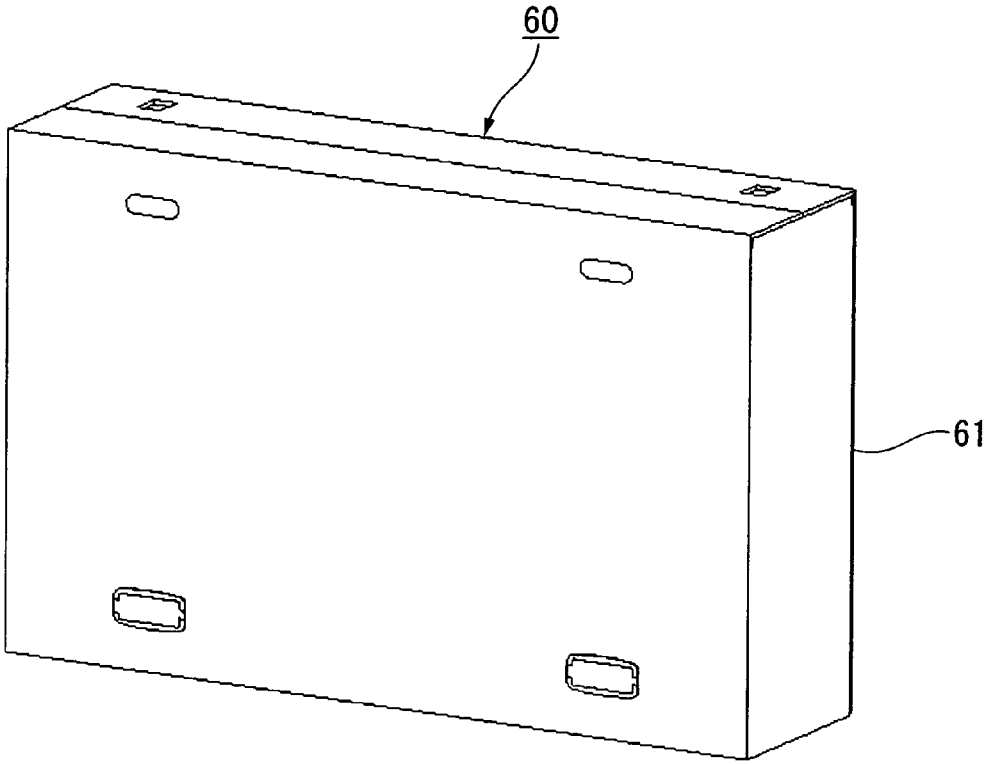
FIG. 10 is a perspective view that shows a packing box in which the thin display device of FIG. 9 is stored.
Figure 11:
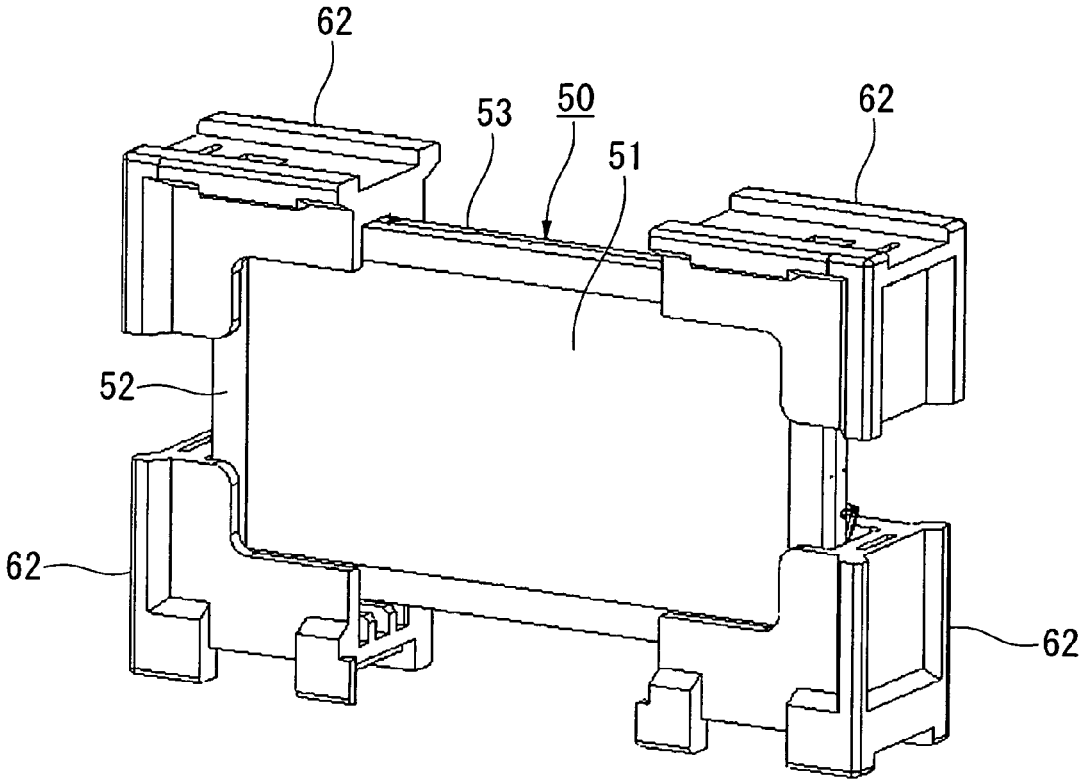
FIG. 11 is a perspective view that shows the state of a cushioning material attached to the thin display device of FIG. 9.
Figure 12:
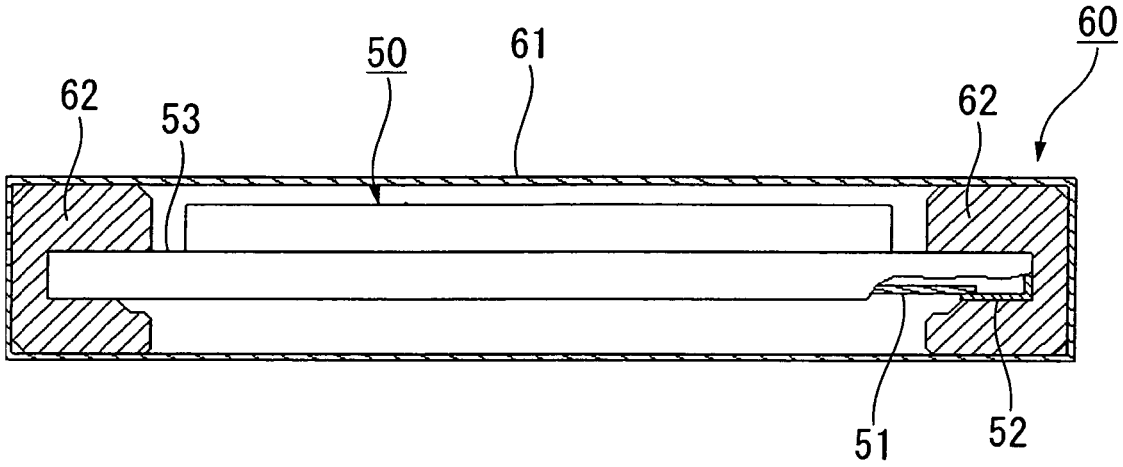
FIG. 12 is a transverse sectional view that shows the state of the thin display device on which the cushioning material is attached being stored in a packing box.
Figure 13:
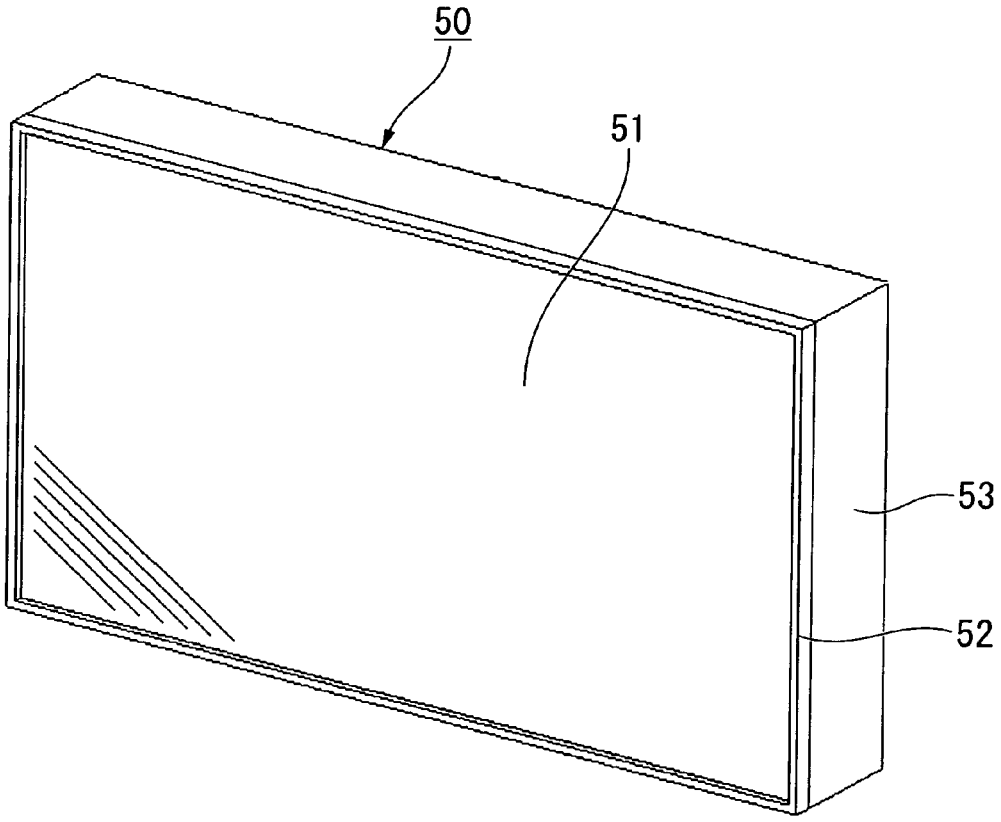
FIG. 13 is a perspective view that shows a thin display device that is provided with a narrow frame.

The first cushioning member 22, in the case of being viewed in a transverse cross section as shown in FIG. 8, is formed in an L shape, and the portion that makes contact with the back surface of the rear frame 103 of the thin display device 100 is the engaging member 21 that is engaged with the handle 1 of the thin display device 100, and the portion that is arranged at a right angle to the engaging member 21 is a gap forming member 25 for forming a gap 30 described below.

The second cushioning member 24, as shown in FIG. 8, has a concave-shaped housing portion 26 for housing the first cushioning member 22. The width dimension (shown by the reference symbol A) of the housing portion 26 is formed to be slightly larger than the length dimension of the gap forming member 25 of the first cushioning member 22, and by this dimensional relation, the first cushioning member 22 is fitted and fixed to the concave-shaped housing portion 26. In the case of the first cushioning member 22 that is engaged with the handle 1 of the thin display device 100 being contained in the concave-shaped housing portion 26 of the second cushioning member 24, a gap 30 of a certain interval (refer to FIG. 8) is formed between the protecting member 23 of the second cushioning member 24 and the display screen 101 of the thin display device 100.

In the case of the first cushioning member 22 being contained in the concave-shaped housing portion 26 of the second cushioning member 24, a recess forming member 32 for forming a recess 31 that houses the edge portion 100A of the thin display device 100 is constituted by the engaging member 21 and the gap forming member 25 of the first cushioning member 22, and the protecting member 23 of the second cushioning member 24 (refer to FIG. 8).

As the material of the second cushioning member 24, expanded polyethylene or expanded polystyrene or expanded polypropylene with a foaming ratio of 40 to 50%, which has high cushioning property, is used. Also, as the material of the first cushioning member 22 that serves as a spacer, expanded polystyrene or expanded polypropylene with a foaming ratio of 10 to 30%, which is stronger than the second cushioning member 24, is used.

By means of the materials of this cushioning material 20, weak impacts are received by the second cushioning member 24 on the outer side, and strong impacts that cannot be cushioned by the second cushioning member 24 are received by the first cushioning member 22 on the inner side, whereby it is possible to effectively absorb vibrations and impacts of various kinds during transport.

In this kind of cushioning member 20, in the state of the engaging member 21 of the first cushioning member 22 being engaged in the handle 1 of the thin display device 100, the first cushioning member 22 is stored in the concave-shaped housing portion 26 of the second cushioning member 24. At this time, as a result of the gap forming member 25 of the first cushioning member 22 fitting in the concave-shaped housing portion 26, in addition to the second cushioning member 24 being fixed to the first cushioning member 22, the gap 30 of a certain interval is formed between the protecting member 23 of the second cushioning member 24 and the display screen 101 of the thin display device 100, and the protecting member 23 and the display screen 101 are prevented from making contact by the gap 30.

Also, in the case of the first cushioning member 22 being contained in the concave-shaped housing portion 26 of the second cushioning member 24, a step portion 33 (refer to FIG. 8) is formed between the first cushioning member 22 and the second cushioning member 24. This step portion 33, in the state of the cushioning material 20 being attached to the thin display device 100, makes contact with the handle 1 of the thin display device 100, and thereby having a role of positioning and fixing the cushioning material 20 with respect to the edge portion 100A of the thin display device 100.

Also, the thin display device 100 to which this kind of cushioning material 20 is attached is contained in a cardboard box 34 that serves as a packing material as shown in FIG. 8. This cardboard box 34 is formed to match the external dimensions of the thin display device 100 including the cushioning material 20, and in the case of storing the thin display device 100 together with the cushioning material 20, the cushioning material 20 does not rattle with the support of the step portion 33 that makes contact with the handle 1 of the thin display device 100.

Since the packing structure and packing method according to the second exemplary embodiment as described in detail above provide the recess forming member 32 that includes the engaging member 21, the gap forming member 25, and the protecting member 23 for forming the recess 31 that houses inside the edge portion 100A of the thin display device 100, and provides on the rear frame 103 that is positioned on the back surface of the thin display device 100 the handle 1 that engages and holds the engaging member 21 of the cushioning material 20 in the state of the edge portion 100A of the thin display device 100 being contained in the recess 31 of the cushioning material 20, in order to form the gap 30 between the display screen 101 of the thin display device 100 and the protecting member 23 of the cushioning material 20 that is positioned in front of the display screen 101, the handle 1 can fix the cushioning material 20 in a stable manner with respect to the thin display device 100.

As a result, even if a narrow-width frame 102 that does not have a sufficient surface area around the display screen 101 is used at the edge portion 100A of the thin display device 100, the cushioning material 20 and the display screen 101 are prevented from making contact with each other during packing, and so it is possible to prevent damage to the display screen 101 before it happens.

In the aforementioned first and second exemplary embodiments, the handle 1 and the cushioning material 2/20 that is held by the handle 1 are provided at the corner portions of the edge portion 100A of the thin display device 100, but the handle 1 and the cushioning material 2/20 that is held by the handle 1 may be provided at the intermediate portions of the edge portion 100A, and so the attachment positions thereof are not limited to the corner portions of the edge portion 100A of the thin display device 100.

In the aforementioned first and second exemplary embodiments, one thin display device 100 to which the cushioning material 2/20 is attached is contained in the cardboard box 12/34 as shown in FIG. 4 and FIG. 8, but the number of thin display devices 100 is not limited to one, and a plurality of the thin display devices 100 with the cushioning material 2/20 attached to each one may be stored in a large box.

Hereinabove, exemplary embodiments of the present invention were described in detail with reference to the drawings, but specific constitutions are not limited to these exemplary embodiments, and design modifications are included without departing from the scope of the present invention.

INDUSTRIAL APPLICABILITY

The present invention relates to a packing structure and a packing method applied to a thin display device such as a liquid crystal, plasma, and organic EL display device, and that can exhibit a sufficient cushioning property during transport and storage.

The invention claimed is:

1. A packing structure comprising:

a display device including a display screen and a handle which is provided on a back surface of the display device; and a cushioning material for protecting the display device, wherein the handle includes first and second ends attached to the back surface of the display device, an inner side of the handle facing the back surface of the display device, and the inner side of the handle serving as a holding portion, and wherein the cushioning material includes a recess forming member including:

an engaging member configured to engage with the handle, the engaging member being inserted into the holding portion;

a protecting member arranged in front of the display screen; and a recess provided between the engaging member and the protecting member, an edge portion of the display device being arranged in an inside of the recess.

2. The packing structure according to claim 1, wherein the protecting member is configured to protect the display screen.

3. The packing structure according to claim 2, wherein the handle on the back surface of the display device and the cushioning material that is attached to the handle are provided at corner portions of the display device.

4. The packing structure according to claim 2, wherein the cushioning material has a step portion that abuts the handle.

5. The packing structure according to claim 1, wherein the cushioning material includes expanded plastic having a high cushioning property.

6. The packing structure according to claim 5, wherein the handle on the back surface of the display device and the cushioning material that is attached to the handle are provided at corner portions of the display device.

7. The packing structure according to claim 5, wherein the cushioning material has a step portion that abuts the handle.

8. The packing structure according to claim 1, wherein the cushioning material includes a first cushioning member that has the engaging member , and a second cushioning member that has the protecting member configured to protect the display screen.

9. The packing structure according to claim 8, wherein the second cushioning member includes plastic having a high cushioning property, and the first cushioning member includes high-strength plastic having a lower foaming ratio than the plastic of the second cushioning member.

10. The packing structure according to claim 8, wherein the handle on the back surface of the display device and the cushioning material that is attached to the handle are provided at corner portions of the display device.

11. The packing structure according to claim 9, wherein the handle on the back surface of the display device and the cushioning material that is attached to the handle are provided at corner portions of the display device.

12. The packing structure according to claim 1, wherein the handle on the back surface of the display device and the cushioning material that is attached to the handle are provided at corner portions of the display device.

13. The packing structure according to claim 1, wherein the cushioning material has a step portion that abuts the handle.

14. The packing structure according to claim 1, wherein the display device is contained in a packing box in a state of causing the handle to hold the cushioning material.

15. The packing structure of claim 1, wherein the recess includes a width which is greater than a thickness of the edge portion, such that a gap is formed between the protecting member and the display screen.

16. A packing method that uses a cushioning material for packing a display device, the packing method comprising:

providing a display device including a display screen and a handle which is provided on a back surface of the display device, the handle including first and second ends attached to the back surface of the display device, an inner side of the handle facing the back surface of the display device, and the inner side of the handle serving as a holding portion;

preparing a recess forming member including:

an engaging member configured to engage to the handle;

a protecting member; and a recess provided between the engaging member and the protecting member;

inserting the engaging member into the holding portion;

arranging the protecting member in front of the display screen; and arranging an edge portion of the display device in an inside of the recess.

17. The packing method according to claim 16, wherein the cushioning material includes expanded plastic having a high cushioning property.

18. The packing method according to claim 17, wherein the handle on the back surface of the display device and the cushioning material that is attached to the handle are provided at corner portions of the display device.

19. The packing method according to claim 16, wherein a step portion that abuts the handle on an outer side of the cushioning material is formed.

20. The packing method according to claim 16, wherein the display device is contained in a packing box in a state of causing the handle to hold the cushioning material.

21. The packing structure according to claim 2, wherein the cushioning material includes expanded plastic having a high cushioning property.

* * * * *